US012528571B1

(12) United States Patent
Needham et al.

(10) Patent No.: US 12,528,571 B1
(45) Date of Patent: Jan. 20, 2026

(54) TILLERS FOR MARINE DRIVES HAVING AMBIDEXTROUS FUNCTIONALITY

(71) Applicant: Brunswick Corporation, Mettawa, IL (US)

(72) Inventors: Gary D. Needham, Stillwater, OK (US); Scott G. Ahlswede, Plymouth, WI (US); Ronald L. Hall, Hartford, WI (US); Robert A. Podell, Slinger, WI (US); Andrew J. Przybyl, Berlin, WI (US)

(73) Assignee: Brunswick Corporation, Mettawa, IL (US)

( * ) Notice: Subject to any disclaimer, the term of this patent is extended or adjusted under 35 U.S.C. 154(b) by 573 days.

(21) Appl. No.: 17/961,367

(22) Filed: Oct. 6, 2022

(51) Int. Cl.
*B63H 20/12* (2006.01)
*B63B 79/40* (2020.01)
*B63H 20/10* (2006.01)

(52) U.S. Cl.
CPC ..... *B63H 20/12* (2013.01); *B63B 79/40* (2020.01); *B63H 20/10* (2013.01)

(58) Field of Classification Search
CPC ..... B63H 20/00; B63H 20/12; B63H 79/00; B63H 79/40; B63H 20/10; B63H 21/00; B63H 21/21; B63H 21/213; B63H 21/265; B63H 25/00; B63H 25/10; B63B 79/00
USPC ..... 440/1
See application file for complete search history.

(56) References Cited

U.S. PATENT DOCUMENTS 1,854,196 A 4/1932 Irgens
2,363,854 A 11/1944 Bierenfeld
D188,325 S 7/1960 Brown
3,018,754 A 1/1962 Snyder et al.
3,636,911 A 1/1972 Piazza
3,693,576 A 9/1972 Driscoll
3,853,730 A 12/1974 Anderson
3,865,334 A 2/1975 Wair, Jr.
(Continued)

FOREIGN PATENT DOCUMENTS

AU 2019100942 9/2019
CA 1040134 10/1978
(Continued)

OTHER PUBLICATIONS

Belter, Unpublished U.S. Appl. No. 18/047,360, filed Oct. 18, 2022, "Configurable Shift and Throttle Mechanism for Tiller of Marine Drive" (specification and drawings only).
(Continued)

*Primary Examiner* — Lars A Olson
(74) *Attorney, Agent, or Firm* — Andrus Intellectual Property Law, LLP

(57) ABSTRACT

A tiller is for a marine drive. The tiller has a tiller arm and a grip on the tiller arm, the grip being rotatable out of a center position to control speed of the marine drive. The grip is operable in a right-hand mode in which the grip is only rotatable in a right-hand rotational range away from the center position and the grip is alternately operable in a left-hand mode in which the grip is only rotatable in a left-hand rotational range away from the center position, wherein the right-hand rotational range is diametrically opposite of the left-hand rotational range. A switching device is movable into a right-hand switch position in which the grip is operable in the right-hand mode and alternatively movable into a left-hand switch position in which the grip is operable in the left-hand mode.

20 Claims, 12 Drawing Sheets

(56) References Cited

U.S. PATENT DOCUMENTS 3,953,742 A 4/1976 Anderson et al.
3,955,527 A 5/1976 Holtermann
3,961,595 A 6/1976 Meyer
D246,853 S 1/1978 Berchem
4,071,002 A 1/1978 Frahm
4,295,835 A 10/1981 Mapes et al.
4,318,699 A 3/1982 Wenstadt et al.
4,322,633 A 3/1982 Staerzl
4,331,431 A 5/1982 Estes
D272,357 S 1/1984 Hall et al.
4,447,214 A 5/1984 Henrich
D276,811 S 12/1984 Wolfe
4,492,877 A 1/1985 Staerzl
4,496,326 A 1/1985 Boda
4,504,778 A 3/1985 Evans
4,521,201 A 6/1985 Watanabe
4,528,460 A 7/1985 Staerzl
4,582,493 A 4/1986 Toyohara
4,632,487 A 12/1986 Wargula
4,650,429 A 3/1987 Boda
4,701,141 A 10/1987 Sumigawa
D295,867 S 5/1988 Walsh
4,800,854 A 1/1989 Boda et al.
4,838,820 A 6/1989 Boda et al.
4,878,468 A 11/1989 Boda et al.
4,895,154 A 1/1990 Bartelt
4,897,059 A 1/1990 Newman
4,897,061 A 1/1990 Koepsel et al.
4,911,665 A 3/1990 Hetzel
5,072,809 A 12/1991 Shibata
D323,508 S 1/1992 Hirshberg et al.
5,145,427 A 9/1992 Kawai et al.
D332,265 S 1/1993 Osumi
5,180,320 A 1/1993 Calamia et al.
5,188,548 A 2/1993 Ferguson et al.
5,192,235 A 3/1993 Dunham et al.
5,219,306 A 6/1993 Takahashi
D341,365 S 11/1993 Little et al.
D343,625 S 1/1994 Walthall
5,277,634 A 1/1994 Calamia et al.
5,340,342 A 8/1994 Boda et al.
D352,723 S 11/1994 DeBraal et al.
5,378,178 A 1/1995 Haman
D359,290 S 6/1995 Takeuchi
5,509,836 A 4/1996 Ogasawara et al.
5,511,997 A 4/1996 Yoshida
5,540,606 A 7/1996 Strayhorn
D373,113 S 8/1996 Stringer
5,632,657 A 5/1997 Henderson
D380,478 S 7/1997 Robbins
D387,775 S 12/1997 Iekura
5,707,262 A 1/1998 Huntley et al.
5,747,892 A 5/1998 Staerzl
5,756,949 A 5/1998 Sato
5,797,777 A 8/1998 Tsunekawa et al.
5,840,164 A 11/1998 Staerzl
D412,911 S 8/1999 Iekura
5,967,866 A 10/1999 Willows et al.
D416,871 S 11/1999 Todd
D418,519 S 1/2000 Iekura
6,020,563 A 2/2000 Risk, Jr. et al.
D421,444 S 3/2000 Hatch et al.
D428,616 S 7/2000 Iekura
6,093,066 A 7/2000 Isogawa et al.
6,109,986 A 8/2000 Gaynor et al.
6,146,221 A 11/2000 Natsume
6,183,625 B1 2/2001 Staerzl
D438,493 S 3/2001 Mulliniks et al.
6,209,472 B1 4/2001 Staerzl
6,264,513 B1 7/2001 Marsh
6,264,516 B1 7/2001 McEathron et al.
D447,123 S 8/2001 Winkler
6,273,771 B1 8/2001 Buckley et al.
D448,037 S 9/2001 Westimayer et al.
6,352,456 B1 3/2002 Jaszewski et al.
D457,166 S 5/2002 Burmeister et al.
6,382,122 B1 5/2002 Gaynor et al.
D458,273 S 6/2002 Burmeister et al.
6,406,342 B1 6/2002 Walczak et al.
6,406,343 B2 6/2002 Kawai et al.
D460,459 S 7/2002 Hansen
D460,465 S 7/2002 Williams
D460,972 S 7/2002 Osumi
D462,363 S 9/2002 Burmeister et al.
D463,447 S 9/2002 Osumi et al.
D463,448 S 9/2002 Osumi et al.
D463,449 S 9/2002 Osumi
D463,800 S 10/2002 Osumi
D466,907 S 12/2002 Ohsumi
6,494,431 B1 12/2002 McCoy
D470,154 S 2/2003 Burmeister et al.
6,524,148 B2 2/2003 Yoshigasaki et al.
6,547,952 B1 4/2003 Staerzl
D474,480 S 5/2003 Zebley, Jr. et al.
D474,784 S 5/2003 Sanschagrin et al.
6,558,213 B1 5/2003 McGowan
6,559,660 B1 5/2003 Staerzl
D478,597 S 8/2003 Zebley, Jr.
6,648,703 B2 11/2003 McChesney et al.
6,663,450 B1 12/2003 Walczak et al.
D485,847 S 1/2004 Sanschagrin et al.
D485,848 S 1/2004 Sanschagrin et al.
D486,500 S 2/2004 Okamoto
D489,380 S 5/2004 Ohsumi et al.
D495,345 S 8/2004 Farlow et al.
D495,716 S 9/2004 Sanschagrin et al.
D497,370 S 10/2004 Katoh
D498,485 S 11/2004 Kuwae
D498,764 S 11/2004 Sanschagrin et al.
6,822,462 B1 11/2004 Staerzl
D500,056 S 12/2004 DeYoung et al.
6,875,066 B2 4/2005 Wolaver
6,902,450 B2 6/2005 Ohtsuki et al.
6,913,498 B1 7/2005 Sheth
6,914,202 B2 7/2005 Sugimoto et al.
7,001,231 B1 2/2006 Halley et al.
D517,096 S 3/2006 Landers et al.
7,064,459 B1 6/2006 Staerzl
7,090,551 B1 8/2006 Lokken et al.
D527,737 S 9/2006 Lekura
D528,128 S 9/2006 Sanschagrin et al.
D528,563 S 9/2006 Sanschagrin et al.
D531,639 S 11/2006 Okamoto
D531,640 S 11/2006 Okamoto
7,131,877 B1 11/2006 Staerzl
D536,704 S 2/2007 Iekura
D537,838 S 3/2007 Iekura
7,210,973 B2 5/2007 Sanschagri et al.
7,214,113 B2 5/2007 Kojima
D549,240 S 8/2007 Okamoto
7,267,592 B1 9/2007 Ingebritson et al.
D552,129 S 10/2007 Steinberg
D552,130 S 10/2007 Steinberg et al.
7,305,928 B2 12/2007 Bradley et al.
D560,050 S 1/2008 Tokach et al.
D563,907 S 3/2008 Badarello
D565,607 S 4/2008 Moen et al.
7,381,312 B1 6/2008 Misorski et al.
7,387,553 B1 6/2008 Misorski et al.
7,404,747 B2 7/2008 Shinde et al.
D578,274 S 10/2008 Tokach et al.
7,442,104 B2 10/2008 Okabe
7,455,558 B2 11/2008 Yander
D584,317 S 1/2009 Okamoto
D589,981 S 4/2009 Iekura
7,553,206 B2 6/2009 Hasegawa et al.
7,666,038 B2 2/2010 Yomo et al.
D611,062 S 3/2010 Okamoto
D611,063 S 3/2010 Okamoto
D611,501 S 3/2010 Vignau et al.
D611,502 S 3/2010 Vignau et al.
7,677,938 B2 3/2010 Wiatrowski et al.
7,704,110 B2 4/2010 Wiatrowski et al.
7,736,207 B2 6/2010 Vignau

(56) References Cited

U.S. PATENT DOCUMENTS

| | | | |
|---|---|---|---|
| D623,661 | S | 9/2010 | Yamagishi et al. |
| D624,567 | S | 9/2010 | Kelley |
| D626,975 | S | 11/2010 | Ryczek et al. |
| D629,818 | S | 12/2010 | Rummer et al. |
| D635,154 | S | 3/2011 | Rummer et al. |
| 7,895,959 | B1 | 3/2011 | Angel et al. |
| 7,896,304 | B1 | 3/2011 | Eichinger et al. |
| D635,586 | S | 4/2011 | Okamoto |
| 7,976,354 | B2 | 7/2011 | Kubota et al. |
| D643,440 | S | 8/2011 | Dannenberg et al. |
| 8,106,617 | B1 | 1/2012 | Holley |
| 8,118,983 | B1 | 2/2012 | Anderson et al. |
| D655,308 | S | 3/2012 | Steinberg |
| D655,320 | S | 3/2012 | Hiraoka et al. |
| D657,400 | S | 4/2012 | Loew |
| D660,323 | S | 5/2012 | Hiraoka et al. |
| D660,614 | S | 5/2012 | Palmeiri |
| D663,321 | S | 7/2012 | Okamoto |
| 8,257,122 | B1 | 9/2012 | Holley |
| 8,372,260 | B1 | 2/2013 | Staerzl et al. |
| 8,651,906 | B1 | 2/2014 | Morton |
| D706,313 | S | 6/2014 | Higashikawa et al. |
| D707,729 | S | 6/2014 | Jackson et al. |
| D708,233 | S | 7/2014 | Furuki et al. |
| D709,918 | S | 7/2014 | Jones, Sr. |
| D712,931 | S | 9/2014 | Matsumoto |
| D714,345 | S | 9/2014 | Petit et al. |
| D715,333 | S | 10/2014 | Jacobsthal et al. |
| D716,846 | S | 11/2014 | Carter et al. |
| 8,930,050 | B2 | 1/2015 | Garon et al. |
| D727,969 | S | 4/2015 | Okamoto |
| 9,004,964 | B2 | 4/2015 | Grez |
| D728,640 | S | 5/2015 | Turner et al. |
| 9,039,469 | B1 | 5/2015 | Calamia et al. |
| 9,073,616 | B1 | 7/2015 | Wiegele et al. |
| 9,109,616 | B1 | 8/2015 | Ballentine |
| D740,858 | S | 10/2015 | Dannenberg et al. |
| 9,168,979 | B1 | 10/2015 | Schueller et al. |
| 9,180,950 | B1 | 11/2015 | Davenport et al. |
| 9,205,906 | B1 | 12/2015 | Eichinger |
| 9,216,805 | B1 | 12/2015 | Amerling et al. |
| D757,126 | S | 5/2016 | Vaninetti et al. |
| 9,359,059 | B1 | 6/2016 | Scherer, III et al. |
| 9,359,981 | B1 | 6/2016 | Waisanen et al. |
| 9,376,194 | B1 | 6/2016 | Jensen et al. |
| 9,422,045 | B2 | 8/2016 | Kinpara et al. |
| 9,446,828 | B1 | 9/2016 | Groeschel et al. |
| 9,481,438 | B1 | 11/2016 | Tuchscherer |
| 9,580,947 | B1 | 2/2017 | Amerling et al. |
| 9,587,601 | B1 | 3/2017 | Ochiai |
| D791,189 | S | 7/2017 | Scherer, III et al. |
| 9,694,892 | B1 | 7/2017 | Anschuetz et al. |
| 9,701,383 | B1 | 7/2017 | Stuber et al. |
| D794,078 | S | 8/2017 | Vaninetti |
| D794,079 | S | 8/2017 | Vaninetti et al. |
| 9,764,813 | B1 | 9/2017 | Zarembka et al. |
| 9,783,278 | B1 | 10/2017 | Dannenberg et al. |
| 9,789,945 | B1 | 10/2017 | Vaninetti et al. |
| 9,840,316 | B1 | 12/2017 | Jaszewski |
| D806,752 | S | 1/2018 | Vaninetti et al. |
| D807,920 | S | 1/2018 | Vaninetti |
| D809,017 | S | 1/2018 | Noda et al. |
| 9,868,501 | B1 | 1/2018 | Gable et al. |
| 9,926,064 | B1 | 3/2018 | Tuchscherer |
| D816,716 | S | 5/2018 | Abellera et al. |
| 9,963,213 | B1 | 5/2018 | Jaszewski et al. |
| D832,472 | S | 10/2018 | Davis et al. |
| D834,617 | S | 11/2018 | Zin et al. |
| D834,618 | S | 11/2018 | Zin et al. |
| D835,675 | S | 12/2018 | Nakaura et al. |
| 10,155,578 | B1 | 12/2018 | Osthelder et al. |
| 10,202,180 | B1 | 2/2019 | Amerling et al. |
| D842,504 | S | 3/2019 | Davis et al. |
| 10,246,173 | B1 | 4/2019 | Ingebritson |
| D852,230 | S | 6/2019 | Zin et al. |
| D852,848 | S | 7/2019 | Zin et al. |
| D852,849 | S | 7/2019 | Zin et al. |
| D852,850 | S | 7/2019 | Zin et al. |
| 10,343,759 | B2 | 7/2019 | Despineux |
| D859,469 | S | 9/2019 | Zin et al. |
| 10,507,898 | B1 | 12/2019 | Belter et al. |
| 10,578,042 | B2 | 3/2020 | Buis |
| D886,865 | S | 6/2020 | Bailey |
| 10,696,367 | B1 | 6/2020 | Ingebritson et al. |
| 10,723,429 | B1 | 7/2020 | Wiatrowski et al. |
| 10,787,236 | B1 | 9/2020 | Erickson et al. |
| D911,296 | S | 2/2021 | Li |
| 10,940,917 | B2 | 3/2021 | Montague et al. |
| D917,565 | S | 4/2021 | Vaninetti et al. |
| 10,981,637 | B1 | 4/2021 | Alby et al. |
| 10,981,639 | B2 | 4/2021 | Kimpara et al. |
| 11,084,563 | B1 | 8/2021 | Pielow et al. |
| 11,097,824 | B1 | 8/2021 | Anderson, Jr. |
| 11,097,826 | B1 | 8/2021 | Dannenberg et al. |
| 11,180,235 | B2 | 11/2021 | Wiatrowski |
| 11,186,352 | B1 | 11/2021 | Erickson et al. |
| 11,214,346 | B1 | 1/2022 | Jaeger et al. |
| 11,352,118 | B1 | 6/2022 | Dengel et al. |
| 11,628,919 | B1 | 4/2023 | Pielow et al. |
| 2002/0142680 | A1 | 10/2002 | Anderson |
| 2003/0024456 | A1 | 2/2003 | Swetish |
| 2003/0176121 | A1 | 9/2003 | Kitsu |
| 2003/0194927 | A1 | 10/2003 | Sanschagrin et al. |
| 2003/0232548 | A1 | 12/2003 | Alby et al. |
| 2004/0107789 | A1 | 6/2004 | Peppard |
| 2004/0121667 | A1 | 6/2004 | Okabe |
| 2004/0137806 | A1 | 7/2004 | Ohtsuki et al. |
| 2005/0262958 | A1 | 12/2005 | Kojima |
| 2006/0172631 | A1 | 8/2006 | Kameoka |
| 2007/0042652 | A1 | 2/2007 | Kitsu et al. |
| 2007/0197109 | A1 | 8/2007 | Yander |
| 2008/0038967 | A1 | 2/2008 | Shinde |
| 2008/0268729 | A1 | 10/2008 | Yomo Shigeki et al. |
| 2009/0075534 | A1 | 3/2009 | Wiatrowski et al. |
| 2010/0147257 | A1 | 6/2010 | Yazaki et al. |
| 2011/0104963 | A1 | 5/2011 | Ellis |
| 2013/0280970 | A1 | 10/2013 | Clarkson et al. |
| 2014/0057508 | A1 | 2/2014 | Litjens et al. |
| 2014/0306505 | A1 | 10/2014 | Koch |
| 2016/0023740 | A1 | 1/2016 | Skrzypchak et al. |
| 2017/0043787 | A1 | 2/2017 | Mangette et al. |
| 2017/0306830 | A1 | 10/2017 | Bruestle et al. |
| 2019/0176952 | A1 | 6/2019 | Clark et al. |
| 2020/0156751 | A1 | 5/2020 | Skrzypchak et al. |
| 2020/0172220 | A1 | 6/2020 | Chung et al. |
| 2021/0061431 | A1 | 3/2021 | Mcginley |
| 2023/0102741 | A1 | 3/2023 | Fergus et al. |
| 2023/0257091 | A1 | 8/2023 | Ahlswede |
| 2023/0257092 | A1 | 8/2023 | Ahlswede et al. |
| 2023/0257094 | A1 | 8/2023 | Jaszewski et al. |

FOREIGN PATENT DOCUMENTS

| | | |
|---|---|---|
| CA | 1056766 | 6/1979 |
| CA | 2367740 | 7/2002 |
| EP | 1101696 | 5/2001 |
| EP | 1400720 | 3/2004 |
| EP | 3326903 | 4/2019 |
| GB | 2133592 | 8/1986 |
| JP | S60 38293 | 2/1985 |
| JP | 3946315 | 7/2007 |
| JP | 4094151 | 6/2008 |
| JP | 2011-213215 | 10/2011 |
| JP | 2013-173423 | 9/2013 |
| JP | 5741259 | 7/2015 |
| JP | 5927980 | 6/2016 |
| WO | WO 2004-035381 | 4/2004 |

OTHER PUBLICATIONS

Erikson, et al., "Tiller Tilt Lock and Automatic Release System", Unpublished U.S. Appl. No. 16/257,380, filed Jan. 25, 2019 (specification and drawings only).

(56) References Cited

OTHER PUBLICATIONS

Mercury Marine, 15/20hp EFI Fourstroke Outboard Tiller, tiller handle, available at least as early as Nov. 17, 2017.
Mercury Marine, Big Tiller for 75-300 HP Mercury Outboards, tiller handle, available at least as early as 2018, admitted prior art.
Pielow et al., "Tiller for Outboard Motor," Unpublished U.S. Appl. No. 16/718,566, filed Dec. 18, 2019 (specification and drawings only).
Vaninetti et al, "Tiller for Outboard Motor," Unpublished U.S. Appl. No. 29/610,556, filed Jul. 13, 2017.
Sawyer et al., Unpublished U.S. Appl. No. 17/469,479, filed Sep. 8, 2021.
Fergus et al., Unpublished U.S. Appl. No. 17/487,116, filed Sep. 28, 2021.
Schrank et al., Unpublished U.S. Appl. No. 17/509,739, filed Oct. 25, 2021.
Jaszewski, et al., Unpublished U.S. Appl. No. 17/550,463, filed Dec. 14, 2021.
Dannenberg, et al., Unpublished U.S. Appl. No. 17/554,540, filed Dec. 17, 2021.
Jaszewski, et al., Unpublished U.S. Appl. No. 17/585,214, filed Jan. 26, 2022.
Waldvogel, et al., Unpublished U.S. Appl. No. 17/671,041, filed Feb. 14, 2022.
Declaration of Prior Art signed by inventor Benjamin C. Wald on Sep. 2, 2022.
Fergus, et al., Unpublished U.S. Appl. No. 17/487,116.
Jaszewski, et al., Unpublished U.S. Appl. No. 17/585,214.

TILLERS FOR MARINE DRIVES HAVING AMBIDEXTROUS FUNCTIONALITY

FIELD

The present disclosure relates to marine drives and particularly to tillers for marine drives.

BACKGROUND

The following U.S. patents are incorporated herein by reference in entirety.

U.S. Pat. No. 11,186,352 discloses a tiller system for steering a marine propulsion device. The tiller system includes a tiller arm rotatably coupled to the marine propulsion device. The tiller arm is rotatable from a down position to an up position through a plurality of lock positions therebetween. A toothed member is coupled to one of the tiller arm and the marine propulsion device. The toothed member defines a plurality of teeth corresponding to the plurality of lock positions for the tiller arm. A pawl is coupled to another of the tiller arm and the marine propulsion device, where the pawl engages with the plurality of teeth to prevent the tiller arm from rotating downwardly through the plurality of lock positions.

U.S. Pat. No. 11,097,826 discloses a tiller for an outboard marine drive including a tiller body that is elongated along a tiller axis between a fixed end connected to an outboard marine drive and a distal end. A lanyard switch on the tiller body is configured to prevent operation of the outboard marine drive when a lanyard clip is not attached to the lanyard switch. A controller is configured to identify that an operator has provided user input to start the outboard marine drive and that the lanyard clip is not connected to the lanyard switch.

U.S. Pat. No. 10,787,236 discloses a tiller system for steering an outboard motor. The tiller system includes a tiller arm that is rotatably coupled to the outboard motor. The tiller arm is rotatable from a down position to an up position through a plurality of lock positions therebetween. A tilt lock system is coupled between the tiller arm and the outboard motor and is configured to be activated and deactivated. When activated, the tilt lock system prevents the tiller arm from rotating downwardly through each of the plurality of lock positions. The tiller arm is further rotatable into an unlock position, whereby rotating the tiller arm into the unlock position automatically deactivates the tilt lock system so that the tiller arm is freely rotatable downwardly through the plurality of lock positions.

U.S. Pat. No. 10,696,367 discloses a tiller for an outboard motor has a throttle grip which is manually rotatable through first and second ranges of motion into and between an idle position in which the outboard motor is controlled at an idle speed, and first and second open throttle positions, respectively, in which the outboard motor is controlled at an above-idle speed. A throttle shaft is coupled to the throttle grip and is configured so that rotation of the throttle grip causes rotation of the throttle shaft, which changes a throttle position of a throttle of the outboard motor. A rotation direction switching mechanism is manually movable into a first position in which rotation of the throttle grip through the first range of motion controls the throttle of the outboard motor and alternately manually movable into a second position in which rotation of the throttle grip through the second range of motion controls the throttle position.

U.S. Pat. No. 10,246,173 discloses a tiller for an outboard motor which has a manually operable shift mechanism configured to actuate shift changes in a transmission of the outboard motor amongst a forward gear, reverse gear, and neutral gear. The tiller also has a manually operable throttle mechanism configured to position a throttle of an internal combustion engine of the outboard motor into and between the idle position and a wide-open throttle position. An interlock mechanism is configured to prevent a shift change in the transmission out of the neutral gear when the throttle is positioned in a non-idle position. The interlock mechanism is further configured to permit a shift change into the neutral gear regardless of where the throttle is positioned.

U.S. Pat. No. 9,764,813 discloses a tiller for an outboard motor. The tiller comprises a tiller body that is elongated along a tiller axis between a fixed end and a free end. A throttle grip is disposed on the free end. The throttle grip is rotatable through a first (left handed) range of motion from an idle position in which the outboard motor is controlled at idle speed to first (left handed) wide open throttle position in which the outboard motor is controlled at wide open throttle speed and alternately through a second (right handed) range of motion from the idle position to a second (right handed) wide open throttle position in which the outboard motor is controlled at wide open throttle speed.

SUMMARY

This Summary is provided to introduce a selection of concepts which are further described herein below in the Detailed Description. This Summary is not intended to identify key or essential features of the claimed subject matter, nor is it intended to be used as an aid in limiting scope of the claimed subject matter.

In non-limiting examples disclosed herein, a tiller is for a marine drive. The tiller has a tiller arm and a grip on the tiller arm, the grip being rotatable out of a center position to control speed of the marine drive. The grip is operable in a right-hand mode in which the grip is only rotatable in a right-hand rotational range away from the center position and the grip is alternately operable in a left-hand mode in which the grip is only rotatable in a left-hand rotational range away from the center position, wherein the right-hand rotational range is diametrically opposite of the left-hand rotational range. A switching device is movable into a right-hand switch position in which the grip is operable in the right-hand mode and alternatively movable into a left-hand switch position in which the grip is operable in the left-hand mode.

The switching device can be located on opposite sides of the tiller arm. The switching device can be manually accessible from opposite sides of the tiller arm. The switching device may protrude through opposite sides of the tiller arm. The switching device may be configured so that pressing the switching device inwardly relative to a first side of the tiller arm causes the switching device to prevent rotation of the grip out of the center position towards the second side and alternately so that pressing the switching device inwardly relative to the second side of the tiller arm causes the switching device to prevent rotation of the grip out of the center position towards the first side. In certain examples, the switching device is prevented from moving into or out of the right-hand switch position or the left-hand switch position when the grip is not in the center position.

In certain examples, a shaft has an inner end in the tiller arm and an opposite outer end extending from the tiller arm and supporting the grip so that rotation of the grip causes rotation of the shaft. In the right-hand mode the switching device prevents rotation of the shaft in the left-hand rotational range and in the left-hand mode the switching device prevents rotation of the shaft in the right-hand rotational range.

In certain examples, the switching device comprises radially opposing first and second engagement flanges on the shaft and an engagement member located in the tiller arm, the engagement member being radially movable relative to the shaft, into and out of circumferential alignment with the radially opposing first and second engagement flanges, to alternately prevent or permit rotation of the grip in the right-hand rotational range or left-hand rotational range. The engagement member may have opposing first and second engagement surfaces and opposing first and second ends which protrude through the opposite sides of the tiller arm, respectively, wherein the engagement member is configured so that manually pressing the first end radially inwardly towards the shaft moves the first engagement surface into circumferential alignment with the first engagement flange and simultaneously moves the second engagement surface out of circumferential alignment with the second engagement flange, thus permitting rotation of the grip in only one of the right-hand rotational range or left-hand rotational range, and conversely so that manually pressing the second end radially inwardly towards the shaft moves the second engagement surface into circumferential alignment with the second engagement flange and simultaneously moves the first engagement surface out of circumferential alignment with the first engagement flange, thus permitting rotation of the grip in only the other one of the right-hand rotational range or left-hand rotational range. The engagement member may comprise an elongated member which extends around the shaft and protrudes through the opposite sides of the tiller arm.

In some examples, the switching device may comprise a semi-annular rib on the shaft, wherein the radially opposing first and second engagement flanges are on opposite ends of the semi-annular rib, respectively. The semi-annular rib advantageously prevents movement of the switching device into or out of the right-hand switch position or the left-hand switch position when the grip is out of the center position.

In some examples, a detent mechanism is provided which tends to retain the switch device in the right-hand switch position and alternately in the left-hand switch position. The detent mechanism may comprise opposing first and second spring-biased members which engage with opposing first and second grooves on the engagement member, wherein the first and second spring-biased members each have a natural resiliency which biases the respective spring-biased member into engagement with a respective groove when the respective groove is aligned with the respective spring-biased member.

In some examples, the tiller is part of a propulsion system comprising a marine drive, the tiller, a controller configured to control the speed of the marine drive based upon the rotational position of the grip, and an input device for commanding the controller to operate according to the right-hand control mode or alternately in a left-hand control mode. The controller is configured to prevent a change in speed of the marine drive when the switching device is in the right-hand switch position and controller is commanded to operate according to the left-hand control mode, and also when the switching device is in the left-hand switch position and the controller is commanded to operate according to the right-hand control mode. A sensor is configured to sense rotational position of the grip, wherein the controller is configured to control the speed of the marine drive based upon the rotational position of the grip sensed by the sensor. The input device may be located on the marine drive and/or on the tiller arm. The input device may comprise a touch screen.

BRIEF DESCRIPTION OF THE DRAWINGS

Examples are described with reference to the following drawing figures. The same numbers are used throughout to reference like features and components.

DETAILED DESCRIPTION

Figure 1:
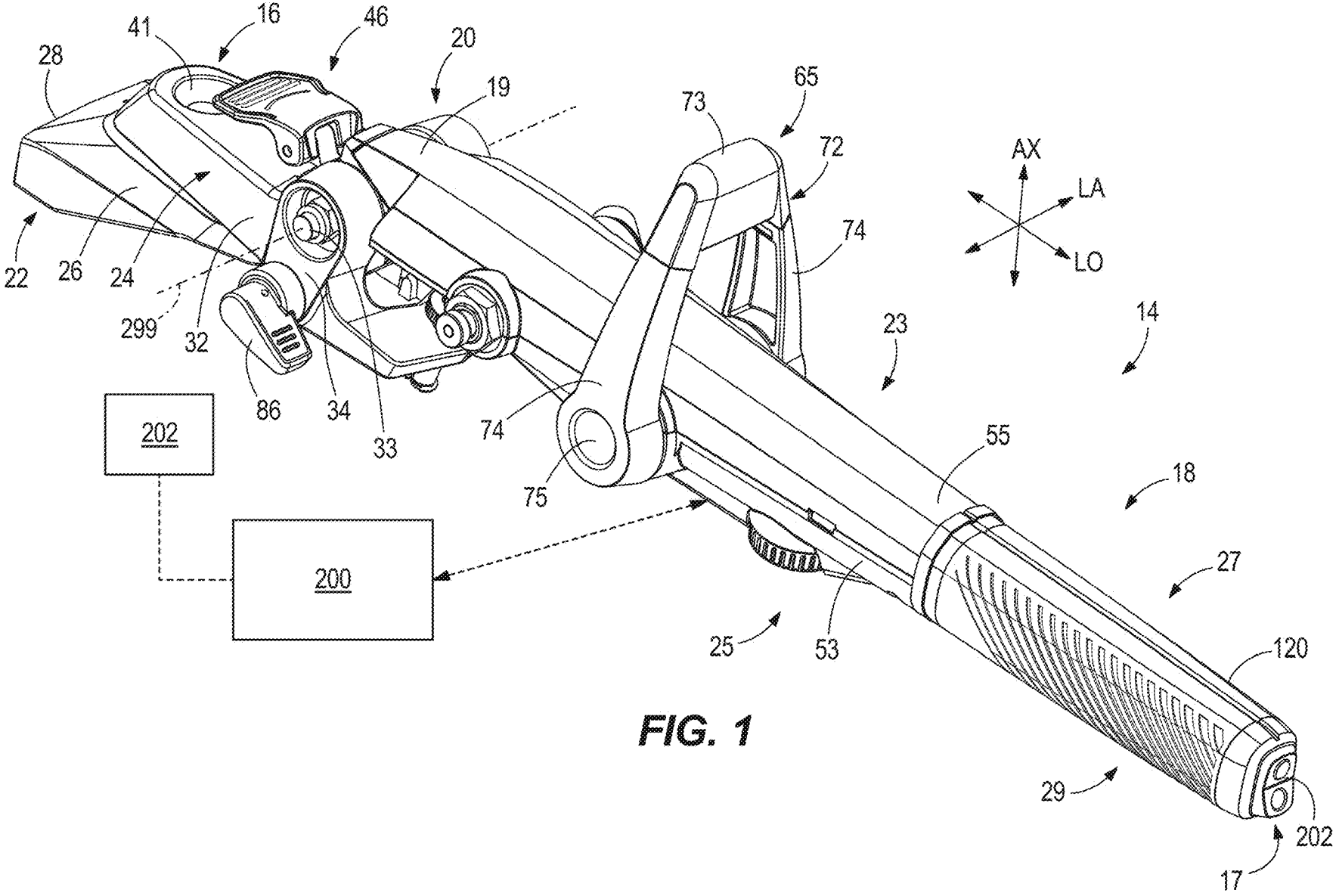
FIG. 1 is a perspective view looking down at a tiller according to the present disclosure.

FIG. 1 illustrates a tiller 14 for controlling a not shown marine drive, such as but not limited to an outboard motor. In general, the tiller 14 has a base bracket assembly 16 and a tiller arm 18 which is coupled to and extends from the base bracket assembly 16. The tiller 14 has several novel attributes which will be further explained herein below. Briefly, the base bracket assembly 16 is specially configured to facilitate yaw adjustment of the tiller arm 18, in particular into and between a variety of yaw positions relative to the marine drive. The tiller 14 has a tilt mechanism 20 which specially facilitates tilting of the tiller arm 18 relative to the base bracket assembly 16 into and between a variety of tilt positions. In addition, the tiller 14 has a novel grip 120 and a switching device 124 which specially facilitate ambidextrous control of the tiller 14 and thus the associated marine drive.

Figure 2:
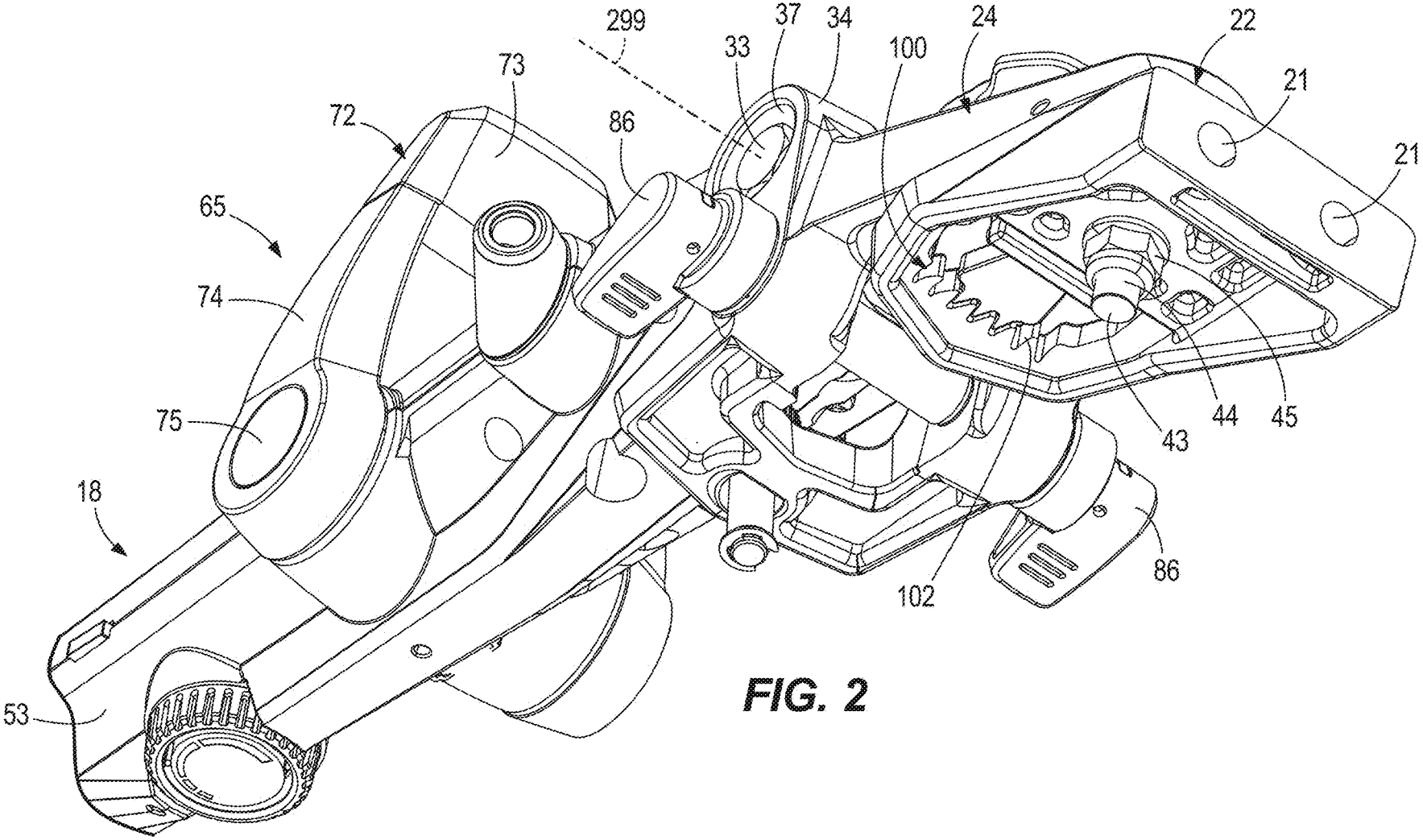
FIG. 2 is a perspective view looking up at the tiller.
Figure 3:
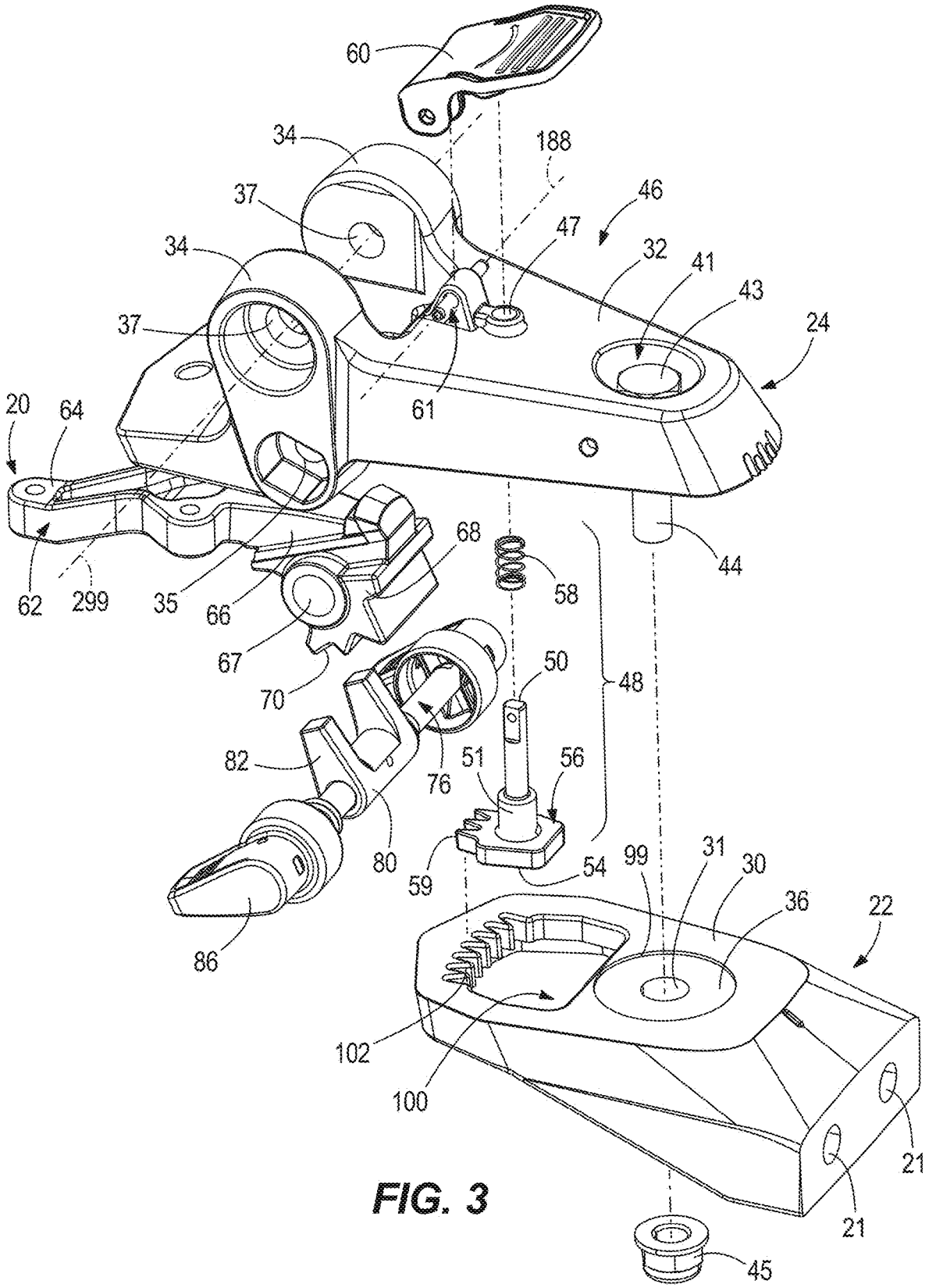
FIG. 3 is an exploded view of portions of the tiller, including a base bracket assembly comprising a yaw bracket and a steering bracket, and a tilt assembly.

Referring to FIGS. 1-3, the base bracket assembly 16 includes a yaw bracket 22 and a steering bracket 24. The yaw bracket 22 is a rigid member having a body 26 and a base 28 which extends from the body 26 and is configured for fixed mounting to a not-shown steering arm of the marine drive by for example, fasteners extending through holes 21 (see FIG. 2) in the end of the base 28. The body 26 of the yaw bracket 22 provides a pedestal 30 (see FIG. 3). A through-bore 31 extends through the center portion of the pedestal 30. A washer 36 is seated in an annular cavity 99 extending about the through-bore 31.

A cutout 100 extends through the pedestal 30 adjacent the annular cavity 99. The cutout 100 is four-sided and has an engagement side which is serrated, including seven, triangular engagement recesses 102. The engagement recesses 102 are positioned so that each recess is separated by a six degree angle, wherein the through-bore 31 is the vertex of each angle. As such, the outermost triangular recesses 102 are separated by a twenty-four degree angle relative to the through-bore 31.

The steering bracket 24 is a rigid member having a body 32 and a pair of upwardly angled arms 34 having opposed lower through-bores 35 through the lower ends of the arms 34 and opposed upper through-bores 37 through the upper ends of arms 34. A fastener 33 extends through the opposed through-bores 37 and through a corresponding through-bore (not shown) in the tiller arm 18 so as to couple the tiller arm 18 to the steering bracket 24 so that the tiller arm 18 is tiltable up and down relative to the steering bracket 24, as will be further described herein below.

A through-bore 41 extends through the body 32. A fastener 43 extends through the through-bore 41, through the washer 36 and through the through-bore 31 in the body 26 and into threaded engagement with a threaded bolt cap 45. As such, the steering bracket 24 is rotatable in either direction relative to the yaw bracket 22 about the fastener 43. As explained above, the yaw bracket 22 is fixed to the steering arm of the marine drive and the steering bracket 24 is attached to the tiller arm 18. Thus, the tiller arm 18 and steering bracket 24 are pivotable together about a yaw axis 152 (see FIG. 5) defined by the fastener 43 into and between a variety of yaw positions relative to the yaw bracket 22 and marine drive, as will be further described herein below.

A yaw lock 46 is specially configured to lock the tiller arm 18 and steering bracket 24 in a variety of yaw positions relative to the yaw bracket 22 and marine drive. The yaw lock 46 includes a spring-biased locking mechanism 48 which resides in a through-bore 47 in the steering bracket 24. The through-bore 47 defines three internal cavities of increasing radius from a top opening 52 toward the cutout 100 of the yaw bracket 22.

The locking mechanism 48 includes an elongated member with a top end 50 which normally protrudes out of the top opening 52, a bottom end 54 which in a locked position protrudes out of the bottom opening, and a serrated foot 56 which includes three engagement teeth 59 corresponding to the engagement recesses 102. A coiled spring 58 is disposed in between the top opening 52 and an enlarged annular body 51 seated on top of the foot 56. The coiled spring 58 biases the locking mechanism 48 toward the cutout 100. The annular body 51 is only capable of passing through the largest of the three internal cavities of the through-bore 47, preventing over compression of the coiled spring 58.

The yaw lock 46 also includes a release lever 60 located on top of the steering bracket 24 so that it is easily manually accessible from above and from the sides of the tiller 14. The release lever 60 has a first end which is pivotably coupled to a mounting boss 61 which protrudes from the top of the steering bracket 24, a second end which can be manually lifted by the operator's finger(s) to pivot the release lever 60 upwardly about a pivot axis 188 defined through the mounting boss 61. The top end 50 of the locking mechanism 48 protrudes out of the top opening and is pivotally coupled to the bottom of the middle portion of the release lever 60, between the first end and the second end.

Figure 4:
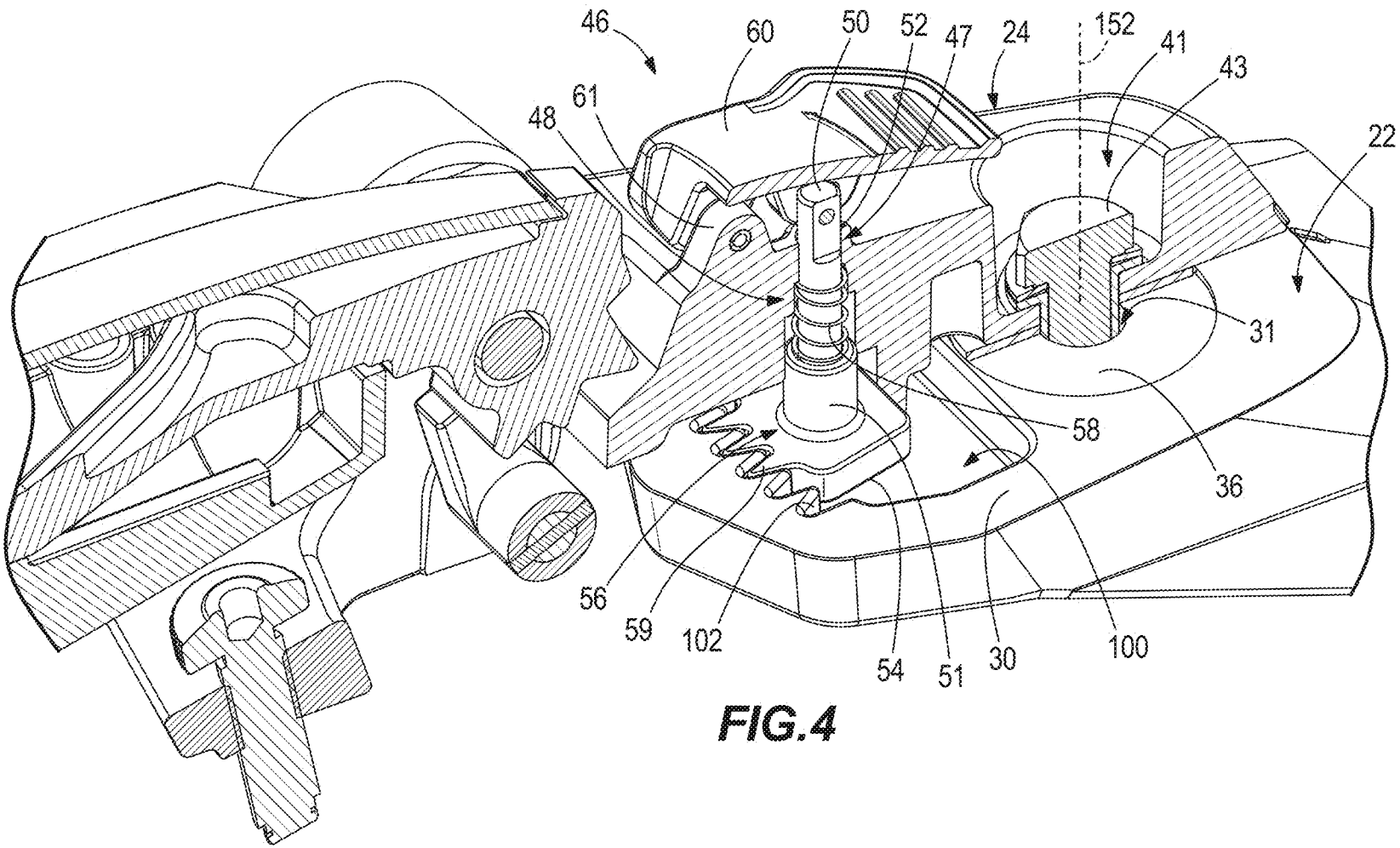
FIG. 4 is a section view of the base bracket assembly, illustrating a yaw lock in an engaged position.
Figure 5:
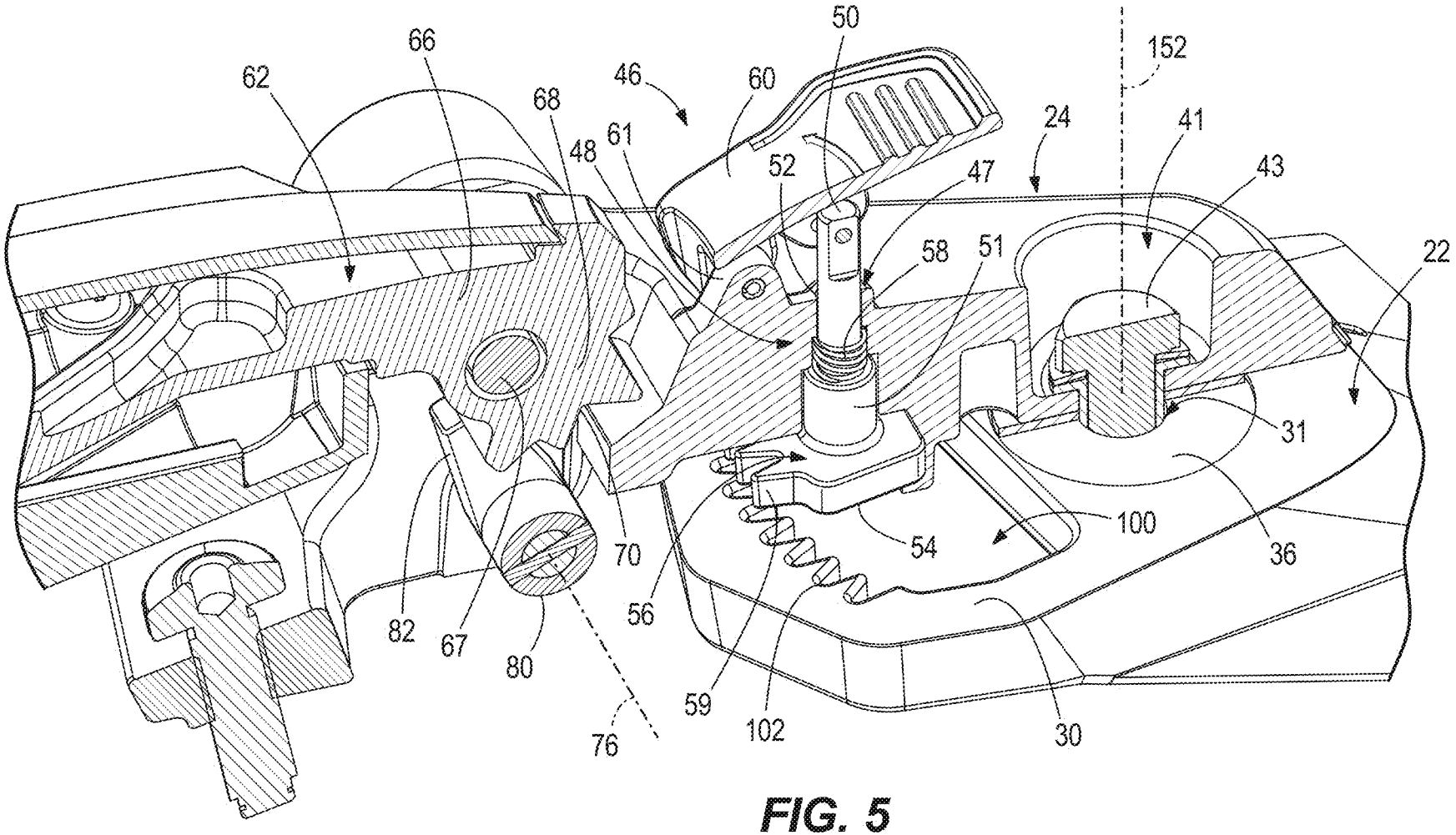
FIG. 5 is a section view of the base bracket assembly, illustrating the yaw lock in a disengaged position.

FIG. 4 shows the yaw lock 46 in a locked position wherein the bottom end 54 of the locking mechanism 48 is biased by the spring 58 so that the center-most engagement tooth 59 engages with the center-most engagement recess 102, thus retaining the steering bracket 24 in a straight-ahead position relative to the yaw bracket 22 and associated marine drive for straight-ahead steering. As shown in FIG. 5, to change the yaw position of the tiller 14 relative to the marine drive, the user manually pivots the first end of the release lever 60 upwardly relative to the mounting boss 61, which pulls upwardly on the locking mechanism 48, compressing the coiled spring 58, and disengaging the foot 56 from the cutout 100. The user can hold the release lever 60 in an upwardly pivoted position, which retains the foot 56 out of engagement with the cutout so that it passes over the engagement recesses 102 thus permitting the user to pivot the steering bracket 24 relative to the yaw bracket 22 freely. Alternatively, the user can pivot the steering bracket 24 into a desired angular position relative to the yaw bracket 22 and release the release lever 60, which permits the spring 58 to bias the second end of the locking mechanism 48 towards and into engagement with the cutout 100. The angular displacement between each of the engagement recesses permits the engagement teeth 59 to lock the steering bracket 24 into a twenty-four degree range, from twelve degrees toward a port side to twelve degrees toward a starboard side, with six degree increments between.

As described herein above, the tiller 14 is pivotable relative to the base bracket assembly 16 via connection between the fastener 33 which extends through a through-bore in the tiller arm 18, through the opposed through-bores 37 in the arms 34. The fastener 33 defines a tilt axis 299 about which the tiller arm 18 is pivotable relative to the base bracket assembly 16.

Referring to FIGS. 1-3, the tiller 14 also has a tilt mechanism 20, which advantageously facilitates selective retainment of the tiller arm 18 in any one of a variety of selectable tilt positions relative to a tilt axis 299 on the base bracket assembly 16. The tilt mechanism 20 includes a tilt bracket 62 which is fastened to the inner end 19 of the tiller arm 18. The tilt bracket 62 has an inner arm 64 which extends into the interior of the tiller arm 18. The tilt bracket 62 extends from the tiller arm 18 and has a body 66. A through-bore 67 extends laterally through the body 66. A ratchet wheel 68 is located on the body 66 and has a series of ratchet recesses 70. The tilt mechanism 20 also includes a tilt shaft axis 78 and is rotatably supported within the opposed through-bores 35 in the arms 34. A pawl 80 is pinned to the middle of the tilt shaft 76, axially between the arms 34. The pawl 80 is rotatable along with the tilt shaft 76 and relative to the base bracket assembly 16. The pawl 80 has opposed teeth 82 for mating with the ratchet recesses 70 on the ratchet wheel 68, as will be further described herein below. The tilt mechanism 20 further includes tilt levers 86 fastened to each end of the shaft. The tilt levers 86 are manually rotatable, which causes rotation of the tilt shaft 76 and pawl 80 about the tilt shaft axis 78 and with respect to the arms 34 to adjust the tilt angle of the tiller arm 18 with respect to the base bracket assembly 16. Operation of the tilt mechanism 20 is not essential to the present disclosure and in other examples the tiller 14 may be embodied without a tilt mechanism or with a differently configured tilt mechanism presently known in the art. Further description of the tilt mechanism shown in the drawings is presented in co-pending U.S. patent application Ser. Nos. 17/880,987; 17/880,999; and Ser. No. 17/881,018, which are incorporated herein by reference.

Referring to FIG. 1, the tiller 14 extends from an inner end 19 to an outer end 17 in a longitudinal direction LO from top 23 to bottom 25 in an axial direction AX which is perpendicular to the longitudinal direction LO, and from a port side 27 to a starboard side 29 which is opposite the port side 27 in a lateral direction LA which is perpendicular to the longitudinal direction LO and perpendicular to the axial direction AX. The tiller 14 has a chassis 53 which is elongated in the longitudinal direction LO and underlies and supports various components associated with the tiller 14. A cover 55 is mounted on top of chassis 53 and encloses the various components in an interior of the tiller 14.

Figure 6:
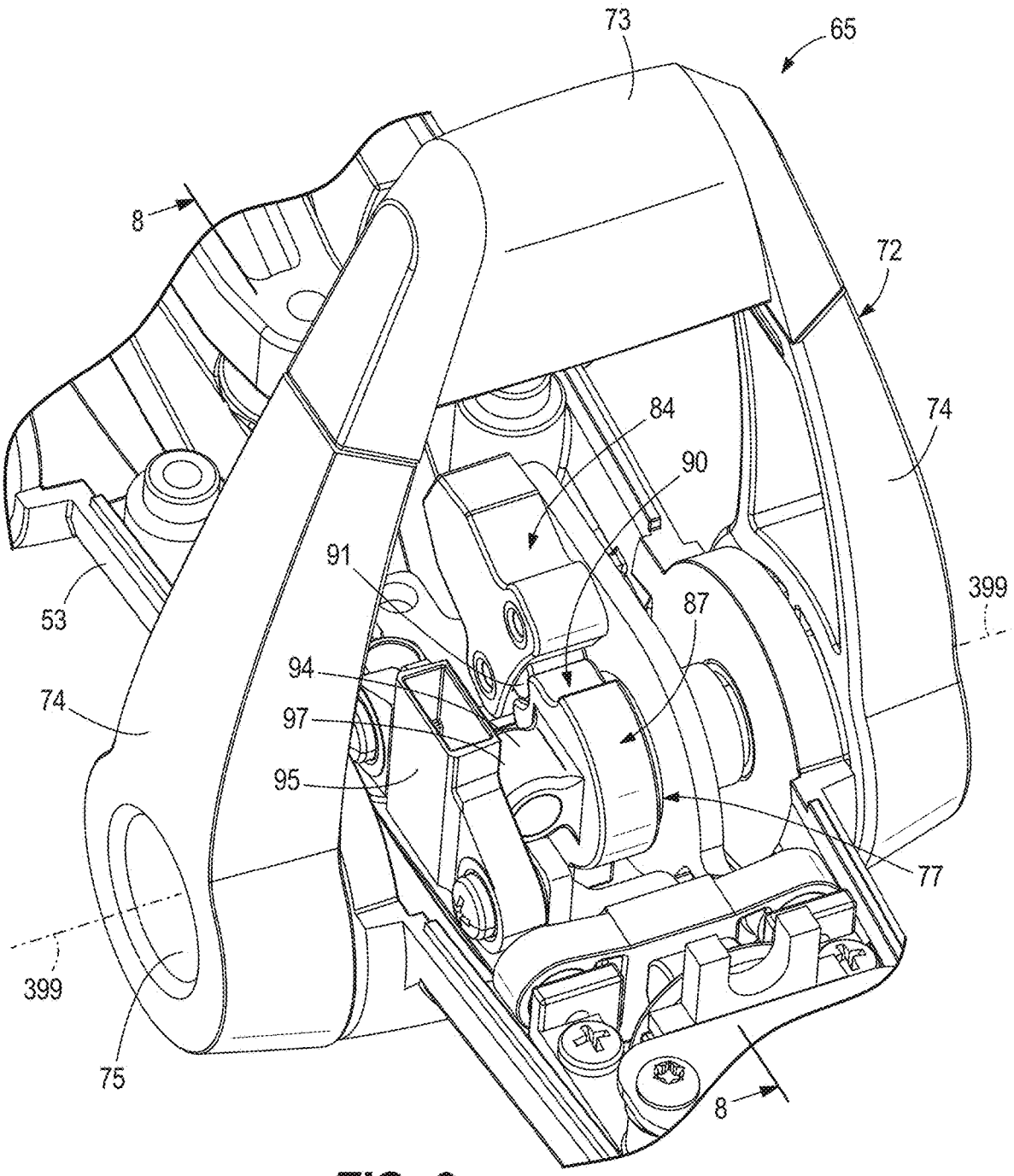
FIG. 6 is a view of the tiller illustrating a shift mechanism.
Figure 7:
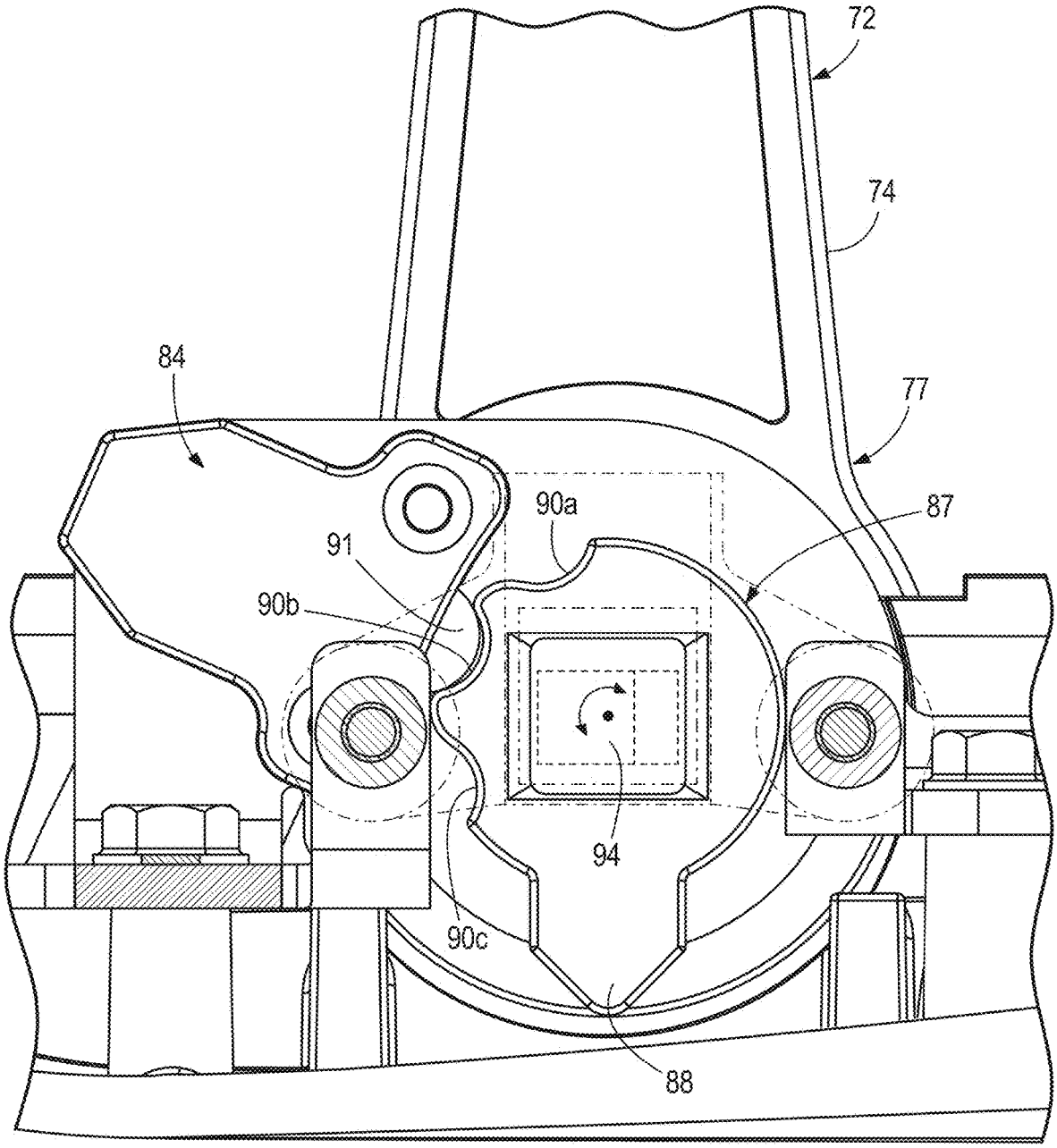
FIG. 7 is a side view of the shift mechanism.
Figure 8:
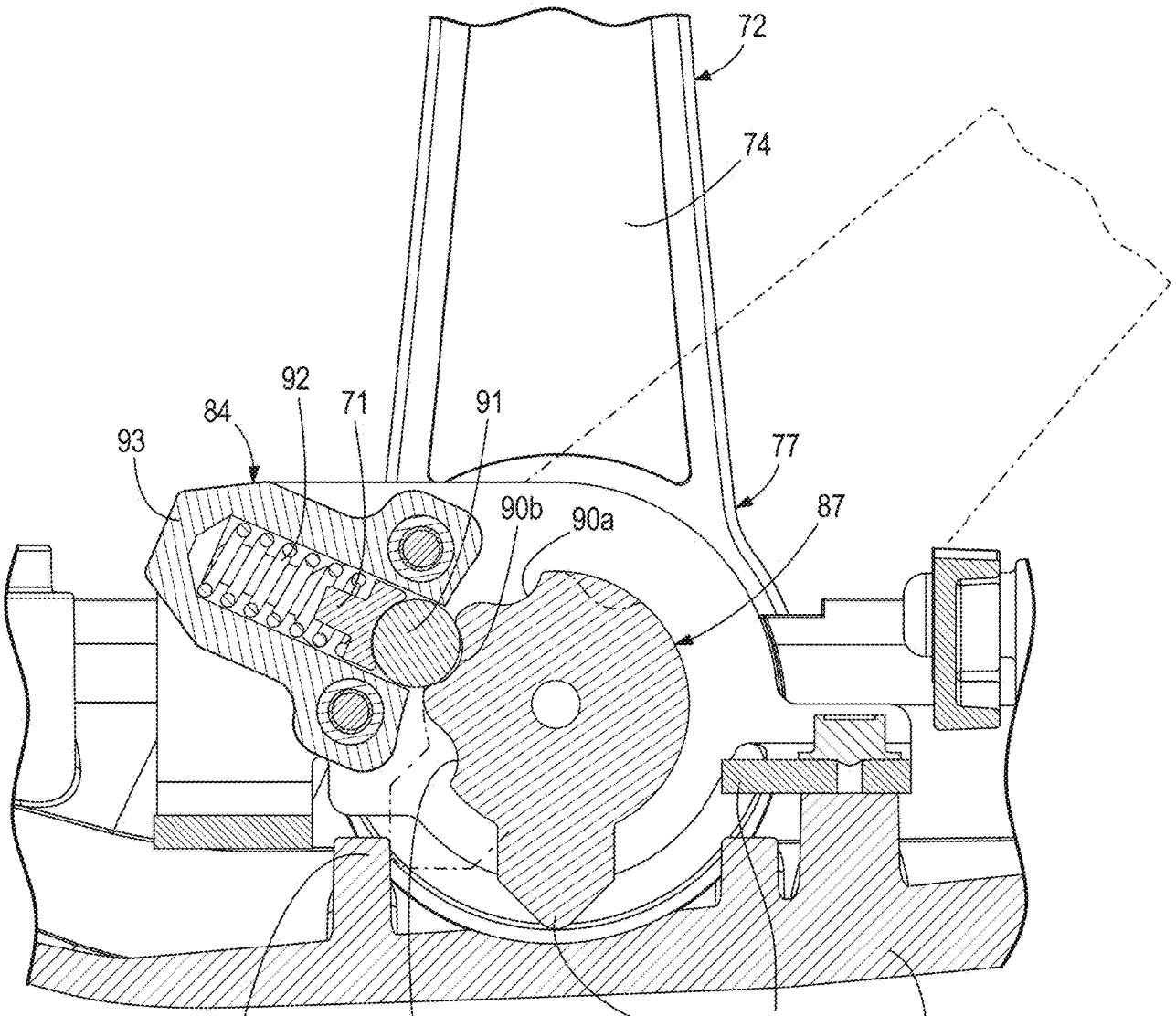
FIG. 8 is view of section 8-8, taken in FIG. 6.

Referring to FIGS. 1 and 6-8, the tiller 14 further has an ambidextrous shift mechanism 65, which permits a user to shift between forward, neutral, and reverse gear from either the port side 27 or the starboard side 29 of the tiller arm 18. The shift mechanism 65 includes a magnetic sensor 95, and a shift lever 72 which facilitates cammed engagement between a control shaft 77 and a detent mechanism 84. As shown in FIG. 8, the magnetic sensor 95 is positioned within the chassis 53 longitudinally in front of the shift lever 72 and faces the control shaft 77.

Referring to FIGS. 6-8, the shift lever 72 is located near the center of the tiller arm 18 between the inner end 19 and the outer end 17 and includes a handle 73 connected to laterally opposing arms 74 which extend downwardly therefrom on either side of the tiller arm 18. A through-bore 75 extends laterally through the lower ends of the arms 74 for coupling to the chassis 53 and the control shaft 77 along a shift axis 399. The control shaft 77 has an inner end coupled to the lever 72 and an outer end 97. The control shaft 77 extends laterally within the internal cavity defined by the chassis 53 and the cover 55 and is fixedly coupled at the inner end to the one of the arms 74 which is positioned on the port side of the tiller 14. The control shaft 77 includes a cam wheel 87. A magnet 94 is mounted at the outer end 97 of the control shaft 77. The magnet 94 is positioned in lateral alignment with the magnetic sensor 95 and rotates upon rotation of the control shaft 77.

The cam wheel 87 has a tooth 88 extending radially relative to the shift axis 399, and three grooves 90*a*, 90*b*, 90*c* located circumferentially adjacent to the tooth 88. The grooves 90*a*, 90*b*, 90*c* are positioned so that each groove corresponds to one of the forward, neutral, and reverse gear orientations. Shown in FIG. 8, the chassis 53 includes protrusions 98 on either side of the tooth 88, which prevent over-rotation of the shift lever 72 in a forward or a reverse direction. The detent mechanism 84 is secured within the chassis 53 in engagement with the cam 87. The detent mechanism 84 includes a body 93 inside of which a plunger 71 extends. The plunger 71 biases a detent ball 91 into one of the grooves 90 via a spring 92.

As shown in FIG. 8, to shift between forward, neutral, and reverse gear, a user moves the shift lever 72 between a forward position (shown in dashed lines), an upright position (shown in solid lines), and a reverse position (not shown). When the shift lever 72 is in the desired position, the detent mechanism 84 engages with one of the grooves 90 corresponding to the desired gear, giving the user a tactical response such as a click or pop, indicating that the lever 72 is in the appropriate position. The relative positioning of the shift lever 72 orients the magnet 94.

Referring to FIG. 1, a controller 200 is provided on the tiller 14 or remotely from the tiller 14, for example on the noted marine drive. The controller 200 has a processor and memory. The processor is configured to operate according to stored programming and in particular is configured to communicate with various external devices including the sensor magnetic sensor 95, access data within the memory, and to control operational characteristics of the marine drive based upon how the position of the magnet 94 compares to data within the memory. The magnetic sensor 95 senses and communicates the orientation of the magnet 94 to the controller 200, which is programmed to compare the orientation of the magnet 94 sensed by the magnetic sensor 95 to values stored in the memory, and based upon the comparison control the marine drive to enact forward, neutral, or reverse operational states of the marine drive.

Figure 9:
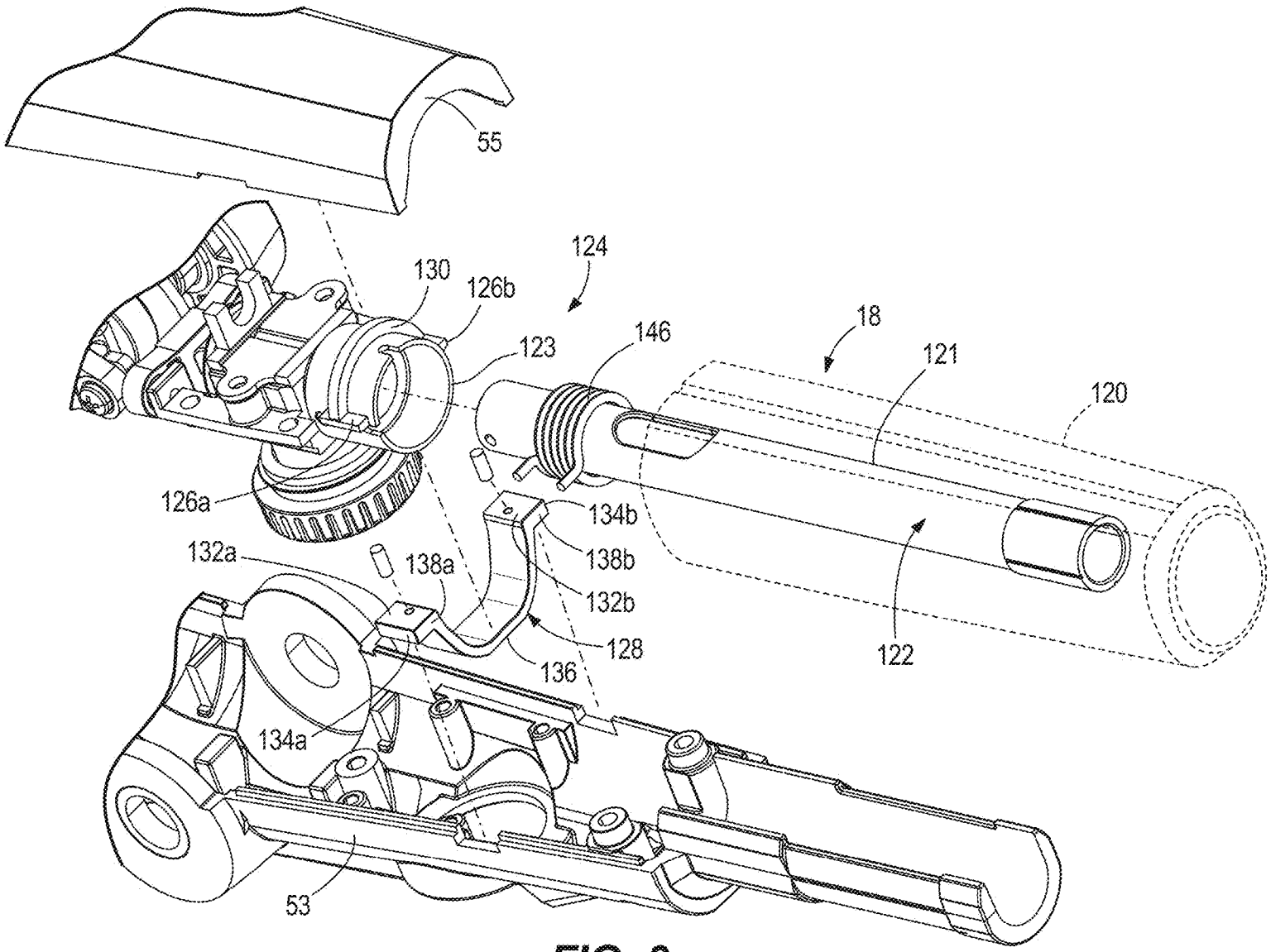
FIG. 9 is an exploded view of an ambidextrous grip and a switching device according to the present disclosure.
Figure 12:
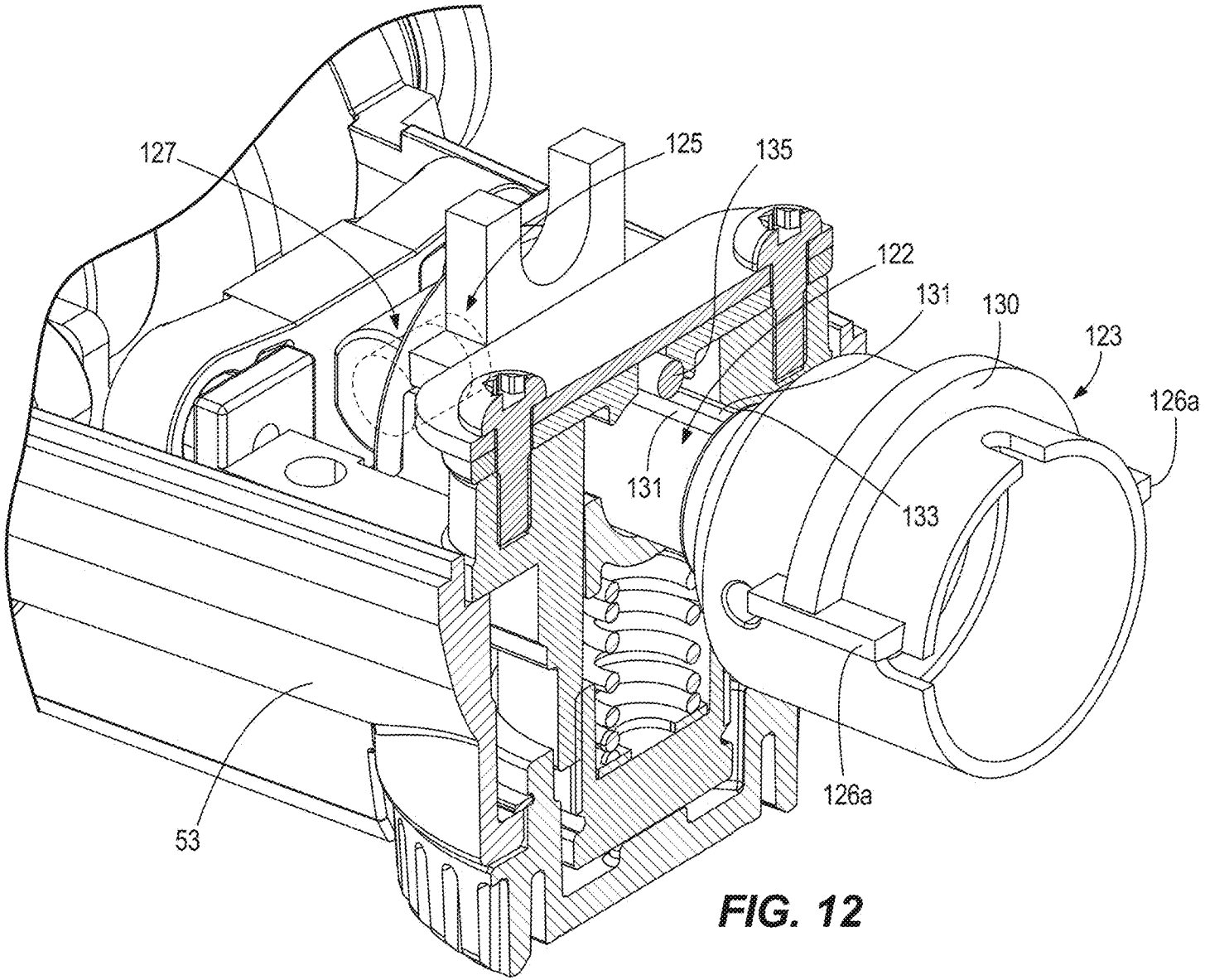
FIG. 12 is a perspective view of the tiller, showing a portion of the switching device.

Referring to FIGS. 1 and 9, the tiller 14 also advantageously has the ambidextrous grip 120, which permits a user to control speed from either the port side 27 or the starboard side 29 of the tiller 14. The grip 120 is supported on a shaft 122 which extends within the chassis 53 and out of the outer end 17. The shaft 122 comprises a shaft body 121 and an shaft extension 123, which is opposite the grip 120, and which is operably engaged with the switching device 124. A magnet 125 (see FIG. 12) is coupled to the inner end of the shaft extension 123. The magnet 125 rotates when the shaft extension 123 is rotated. A magnetic sensor 127 senses the rotational orientation of the magnet 125 and communicates this information to the controller 200. The controller 200 is programmed to compare the orientation of the magnet 125 to stored values in the memory and then control the thrust output of the noted marine drive based upon the comparison.

As further explained herein below, the switching device 124 advantageously facilitates a change between a right-hand mode (FIG. 10) of the tiller 14 and a left-hand mode (FIG. 11) of the tiller 14. In the right-hand mode, the grip 120 is only rotatable in a right-hand rotational range away from the center position (i.e., initially downwardly towards the user positioned on the right side of the tiller 14 from the perspective of FIG. 10.). In the left-hand mode, the grip 120 is only rotatable in a left-hand rotational range away from the center position (i.e., initially downwardly towards the user positioned on the left side of the tiller 14 from the perspective of FIG. 11.). As shown, the left-hand rotational range is diametrically opposite of the right-hand rotational range.

Figure 10:
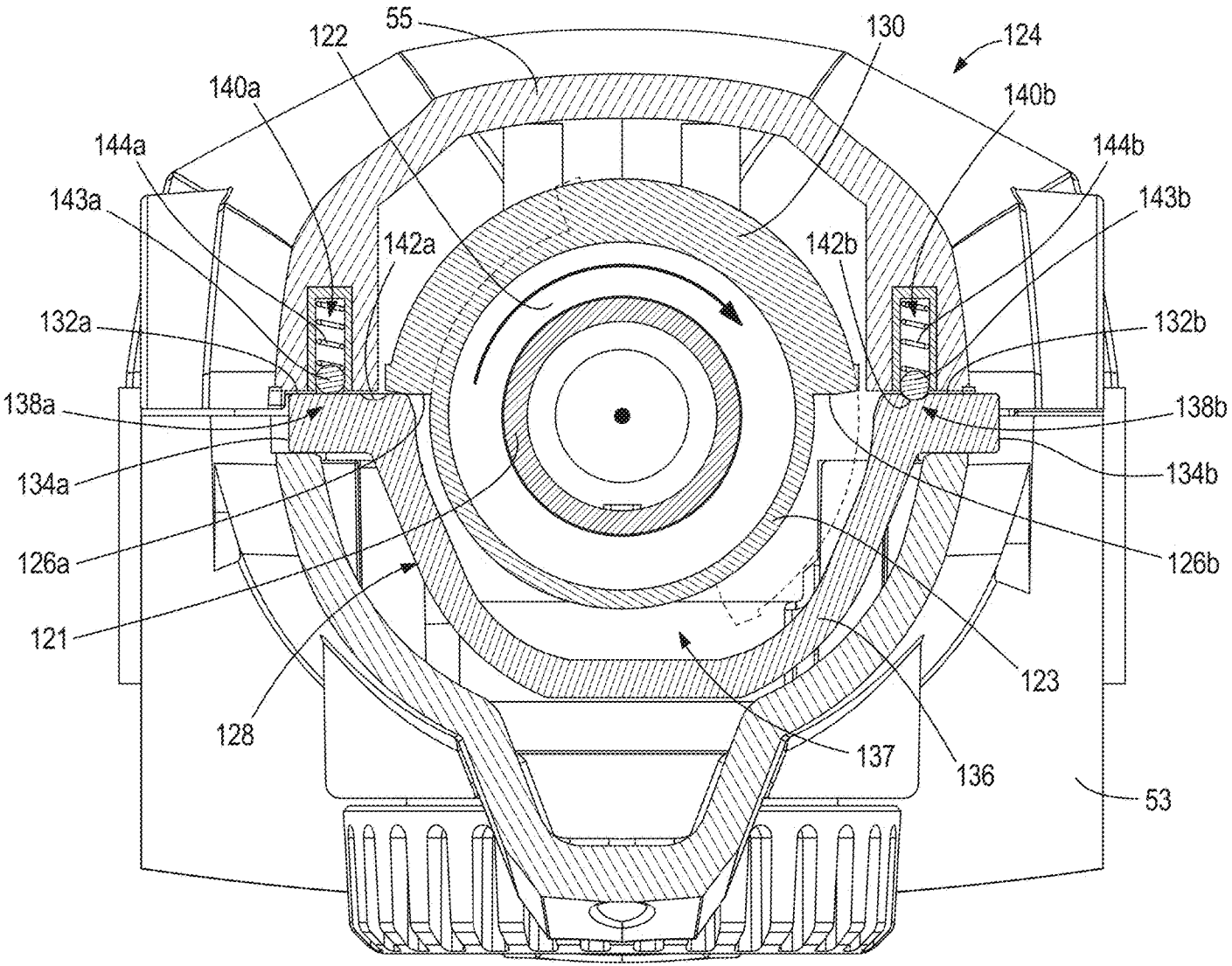
FIG. 10 is a section view, showing the switching device in a right-hand switch position.
Figure 11:
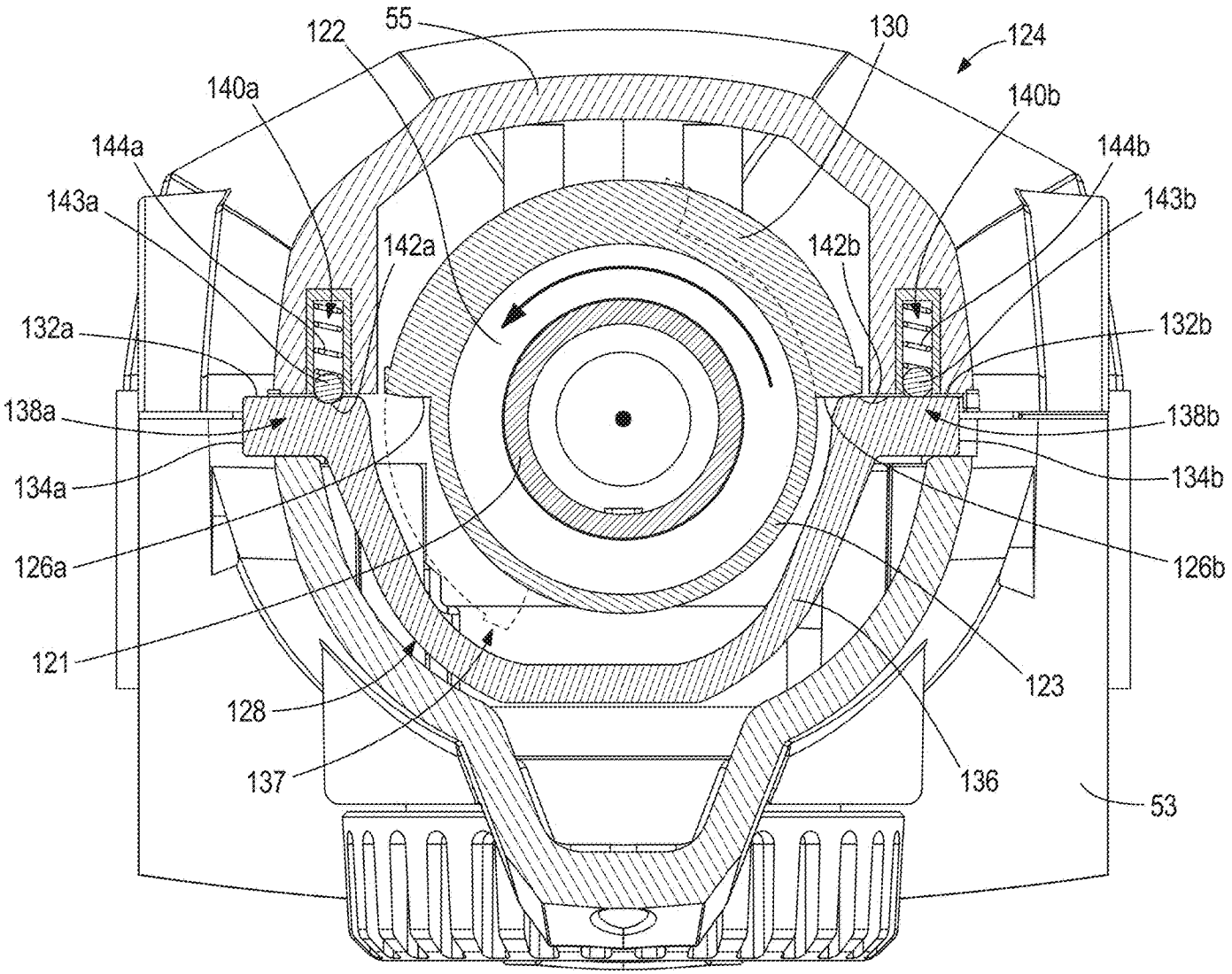
FIG. 11 is a section view, showing the switching device in a left-hand switch position.

Referring to FIGS. 9-11, the switching device 124 generally includes first and second engagement flanges 126*a*, 126*b* on radially opposing sides of the shaft extension 123 as well as an engagement member 128 which as further described herein below is radially movable relative to the shaft extension 123, into and out of circumferential alignment with the engagement flanges 126*a*, 126*b*. The engagement flanges 126*a*, 126*b* are provided on the circumferential ends of a semi-annular rib 130 which is integrally formed with the shaft extension 123. Manual rotation of the grip 120 causes rotation of the shaft 122, including the shaft body 121 and shaft extension 123, which causes rotation of the semi-annular rib 130 and the engagement flanges 126*a*, 126*b*. The engagement member 128 is supported within the chassis 53 and includes opposing first and second engagement tabs 138*a*, 138*b* which protrude through holes in opposite sides of the tiller arm 18 between the chassis 53 and cover 55. The engagement tabs 138*a*, 138*b* have an upward facing engagement surfaces 132*a*, 132*b* and a laterally outward facing end 134*a*, 134*b*, respectively. The engagement member 128 has a semi-circular elongated member 136 which extends below the shaft 122 and connects the engagement tabs 138*a*, 138*b*. As shown in FIGS. 10 and 11, the engagement member 128 generally has a U-shape when viewed in the longitudinal direction LO, wherein the U-shape has laterally outwardly flared ends. The elongated member 136 defines a rotational area 137 within which at least one of the engagement flanges 126*a*, 126*b* are configured to rotate when the grip 120 is manually rotated, as described herein below, according to the right-hand mode (FIG. 10) or the left-hand mode (FIG. 11).

Referring to FIGS. 10 and 11, in the illustrated non-limiting embodiment, first and a second detent mechanisms 140*a*, 140*b* are provided in the cover 55, on radially opposing ends of the tiller arm 18. The detent mechanisms 140*a*,

140*b* are configured to alternately snap-engage the respective engagement surface 132*a*, 132*b* in the right-hand mode and alternately in the left-hand mode. In the illustrated example, each of the engagement surfaces 132*a*, 132*b* includes a groove 142*a*, 142*b*, for receiving a spring-biased member, which in this example is a ball 143*a*, 143*b* that is biased outwardly relative to the cover 55 by first and second springs 144*a*, 144*b*. Each spring 144*a*, 144*b* has a natural resiliency which tends to bias the respective ball 143*a*, 143*b* into engagement with the respective groove 142*a*, 142*b* when the grip 120 is manually rotated to bring the respective groove 142*a*, 142*b* into alignment with the respective ball 143*a*, 143*b*. Such alignment provides a tactile and/or audible click or snap when the respective engagement surface 132*a*, 132*b* slides along the ball 143*a*, 143*b* and the ball 143*a*, 143*b* pops into the respective groove 142*a*, 142*b*, alerting the operator that the respective mode has been engaged. The bias of the spring 144*a*, 144*b* helps retain the engagement member 128 in position via engagement between the ball 143*a*, 143*b* and groove 142*a*, 142*b*.

The grip 120 and shaft 122 are normally rotationally biased by a torsion spring 146 (see FIG. 9) towards a top-dead center position corresponding to zero forward thrust of the marine drive. The torsion spring 146 can be configured differently, such as having two springs, one which is right-hand wound and one which is left-hand wound. Opposing ramp surfaces 131 are provided on either side of a groove 133 for receiving a snap bar 135 which registers the shaft 122 in the top dead center position. This is merely an example and the tiller 14 does not need to have the noted ramp surfaces 131 and groove 133. The ramp surfaces 131 and groove 133 are further described in co-pending U.S. patent application Ser. Nos. 17/880,987; 17/880,999; and Ser. No. 17/881,018, which are incorporated herein by reference. To increase the thrust of the marine drive, the user rotates the grip 120 out of the center position, against the bias of the torsion spring 146, and in particular initially towards and downwardly relative to the user, as permitted by the right-hand mode and alternatively by the left-hand mode. The greater the degree of rotation, the greater the thrust of the marine drive commanded by the controller 200, as described above.

Referring to FIGS. 10 and 11, the switching device 124 is moveable into the right-hand switch position (FIG. 10) to permit right-hand mode of operation and alternately into the right-hand switch position (FIG. 11) to enact left-hand mode of operation, to accommodate both right-handed and left-handed operation, in particular wherein in each mode the grip 120 is only initially rotatable downwardly out of the center position, towards the user. Activation of the right-hand mode is a mirror image of and otherwise identical to activation of the left-hand mode, and as such, the following description of the right-hand mode equally applies to the left-hand mode.

To engage the right-hand mode, as best shown in FIG. 10, the user manually presses the first engagement end 134*a* radially inwards toward the shaft 122. This slides the engagement member 128 to the left in the view of FIG. 10, until the detent mechanism 140*b* snap engages, as shown, thus retaining the engagement member 128 in the right-hand switch position. In the illustrated right-hand switch position, the first engagement surface 132*a* is circumferentially aligned with the first engagement flange 126*a*. The second engagement surface 132*b* is out of circumferential alignment with the second engagement flange 126*b*. As such, as the user rotates the grip 120 downwardly towards the user (clockwise in FIG. 10), the second engagement flange 126*b* moves freely within the rotation area 137 defined by the elongated member 136. However when the user rotates the grip 120 upwardly away from the user (counter-clockwise in FIG. 11), the shaft 122 only rotates uninhibited until the shaft 122 reaches the center position, at which point the first engagement flange 126*a* abuts the engagement surface 132*a* and further rotation is prevented.

Advantageously, the switching device 124 prevents a switch out of a current switch position when the grip 120 is not in the center position. That is, to switch from the right-hand mode to the left-hand mode, the grip 120 and shaft 122 must be fully returned to the top-dead center position. If not, the radially outer surface of the semi-annular 126 is configured to abut the radially inner surface of the elongated member 136 at all rotational positions where the grip 120 is rotated out of the top-dead center position, advantageously so that a change of the mode is prevented when the shaft 122 is positioned out of the center position.

As stated above, the user may move the switching device 124 into the left-hand switch position (FIG. 11) following the same steps described above from the left side of the tiller 14, as shown in FIG. 11.

In non-limiting examples, an input device 202 is provided for commanding the controller 200 to operate the marine drive only according to the right-hand mode or alternately only according to the left-hand mode. The input device 202 can for example include a touch screen which can be located remotely from the tiller 14, for example on the marine drive, or on the tiller 14. In other examples, the input device 202 can also or alternately include one or more buttons located on the tiller 14 or remote from the tiller 14, for example on the marine drive. In these examples, the controller 200 may be programmed to prevent a change in thrust of the marine drive based upon rotation of the ambidextrous grip 120 when the direction of rotation of the grip 120 away from the center position does not match the mode selected via the input device 202. In certain examples, the controller 200 can be programmed to provide an error message to the user, for example via an audible alarm and/or a visual alarm via the touchscreen or any other type of display.

In non-limiting examples, the switching device 124 may be configured differently than the example shown in the drawings. In other examples, the switching device 124 may include a dial or lever located on the bottom of the tiller arm 18, wherein the dial or lever is manually rotatable or switchable to move the switching device 124 into the noted right hand and left hand switch positions. These examples may omit the engagement ends 134*a*, 134*b* protruding through the tiller arm 18 by instead providing the user with a single dial or lever which can be accessed from both sides of the tiller 14. Other mechanical switching devices are presently contemplated and included within this disclosure.

In the present description, certain terms have been used for brevity, clarity, and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. A tiller for a marine drive, the tiller comprising:

a tiller arm;

a grip coupled to the tiller arm, the grip being operable in a right-hand mode in which the grip is only rotatable in a first rotational range away from a center position and alternately in a left-hand mode in which the grip is only rotatable in, an opposite, second rotational range away from the center position; and a switching device configured to switch the tiller between the right-hand mode and the left-hand mode.

2. The tiller according to claim 1, wherein the switching device is manually accessible from opposite sides of the tiller arm.

3. A tiller for a marine drive, the tiller comprising:

a tiller arm;

a grip coupled to the tiller arm, the grip being operable in a right-hand mode in which the grip is rotatable in a first rotational range away from a center position and alternately in a left-hand mode in which the grip is rotatable in an opposite, second rotational range away from the center position; and a switching device configured to switch the tiller between the right-hand mode and the left-hand mode, wherein the switching device is located on opposite sides of the tiller arm.

4. The tiller according to claim 3, wherein the switching device protrudes through opposite sides of the tiller arm.

5. The tiller according to claim 3, wherein the switching device is configured so that pressing the switching device inwardly relative to a first side of the tiller arm causes the switching device to prevent rotation of the grip out of the center position towards a second side of the tiller arm, and alternately so that pressing the switching device inwardly relative to the second side of the tiller arm causes the switching device to prevent rotation of the grip out of the center position towards the first side of the tiller arm.

6. A tiller for a marine drive, the tiller comprising:

a tiller arm;

a grip coupled to the tiller arm, the grip being operable in a right-hand mode in which the grip is rotatable in a first rotational range away from a center position and alternately in a left-hand mode in which the grip is rotatable in an opposite, second rotational range away from the center position; and a switching device configured to switch the tiller between the right-hand mode and the left-hand mode, wherein the switching device is prevented from switching the tiller between the right-hand mode and the left-hand mode when the grip is not in the center position.

7. The tiller according to claim 1, further comprising a shaft having an inner end in the tiller arm and an opposite outer end extending from the tiller arm and supporting the grip so that rotation of the grip causes rotation of the shaft, and further wherein in the right-hand mode the switching device prevents rotation of the shaft in the second rotational range and wherein in the left-hand mode the switching device prevents rotation of the shaft in the first rotational range.

8. The tiller according to claim 7, wherein the shaft and the grip are biased towards the center position.

9. The tiller according to claim 7, wherein the switching device comprises radially opposing first and second engagement flanges on the shaft and an engagement member located in the tiller, wherein the engagement member is radially movable relative to the shaft; into and out of circumferential alignment with the radially opposing first and second engagement flanges; to alternately prevent or permit rotation of the grip in the first rotational range or the second rotational range.

10. The tiller according to claim 9, wherein the engagement member has opposing first and second engagement surfaces and opposing first and second ends which protrude through opposite sides of the tiller arm, respectively, wherein the engagement member is configured so that manually pressing the first end radially inwardly towards the shaft moves the first engagement surface into circumferential alignment with the first engagement flange and simultaneously moves the second engagement surface out of circumferential alignment with the second engagement flange, thus permitting rotation of the grip in only one of the first rotational range or the second rotational range, and conversely so that manually pressing the second end radially inwardly towards the shaft moves the second engagement surface into circumferential alignment with the second engagement flange and simultaneously moves the first engagement surface out of circumferential alignment with the first engagement flange, thus permitting rotation of the grip in only the other one of the first rotational range or the second rotational range.

11. The tiller according to claim 9, wherein the engagement member includes an elongated member which extends around the shaft and protrudes through opposite sides of the tiller arm.

12. The tiller according to claim 9, wherein the switching device includes a semi-annular rib on the shaft, and wherein the radially opposing first and second engagement flanges are on opposite ends of the semi-annular rib, respectively.

13. The tiller according to claim 12, wherein the semi-annular rib prevents operation of the switching device when the grip is out of the center position.

14. The tiller according to claim 9, further comprising detent mechanism configured to retain the switch device in a current position.

15. The tiller according to claim 14, wherein the detent mechanism comprises opposing first and second spring-biased members which engage with opposing first and second grooves on the engagement member, wherein the first and second spring-biased members each have a natural resiliency which biases the respective spring-biased member into engagement with a respective groove when the respective groove is aligned with the respective spring-biased member.

16. A propulsion system comprising:

a marine drive;

the tiller according to claim 1;

a controller configured to control the marine drive based upon a rotational position of the grip;

an input device for commanding the controller to operate according to a right-hand control mode or alternately according to a left-hand control mode;

wherein the controller is configured to prevent a change in operation of the marine drive when the switching device is in a right-hand switch position and the controller is commanded to operate according to the left-hand control mode, and also when the switching device is in a left-hand switch position and the controller is commanded to operate according to the right-hand control mode.

17. The propulsion system according to claim 16, further comprising a sensor configured to sense rotational position of the grip, wherein the controller is configured to control the speed of the marine drive based upon the rotational position of the grip sensed by the sensor.

18. The propulsion system according to claim 16, wherein the input device is located on the marine drive.

19. The propulsion system according to claim 16, wherein the input device is located on the tiller arm.

20. The propulsion system according to claim 16, wherein the input device includes a touch screen.

* * * * *